United States Patent [19]

Iwai

[11] Patent Number: 4,735,046

[45] Date of Patent: Apr. 5, 1988

[54] OIL REMOVER FROM EXHAUST GAS OF MARINE PROPULSION UNIT

[75] Inventor: Tomio Iwai, Hamamatsu, Japan

[73] Assignee: Sanshin Kogyo Kabushiki Kaisha, Japan

[21] Appl. No.: 871,516

[22] Filed: Jun. 6, 1986

[30] Foreign Application Priority Data

Jun. 8, 1985 [JP] Japan ..... 60-124744

[51] Int. Cl.[4] ..... F01N 3/28

[52] U.S. Cl. ..... 60/295; 60/297; 60/298; 60/302

[58] Field of Search ..... 60/295, 298, 302, 297

[56] References Cited

U.S. PATENT DOCUMENTS

| | | | |
|---|---|---|---|
| 3,644,098 | 2/1972 | De Palma | 60/302 |
| 4,023,361 | 5/1977 | Kojima | 60/302 |
| 4,372,111 | 2/1983 | Virk | 60/297 |

FOREIGN PATENT DOCUMENTS

| | | | |
|---|---|---|---|
| 3018277 | 12/1980 | Fed. Rep. of Germany | 60/302 |
| 52-8932 | 3/1977 | Japan . | |
| 55-10043 | 1/1980 | Japan . | |
| 203814 | 12/1982 | Japan | 60/302 |

*Primary Examiner*—Douglas Hart

*Attorney, Agent, or Firm*—Ernest A. Beutler

[57] ABSTRACT

A number of embodiments of treating the exhaust gases of an internal combustion engine with a catalyzer so as to render lubricant in the exhaust gases in a non-polluting form. A number of embodiments applying this principle to marine propulsion units are illustrated and described which include outboard motors and inboards. In each embodiment, the catalyst is position so that the exhaust gases will impinge upon it but need not flow through it for their discharge to the atmosphere. In addition, the exhaust system is designed in such a way that the catalyst may be removed and replaced simply by the use of a removable wall section of the exhaust system.

8 Claims, 6 Drawing Sheets

OIL REMOVER FROM EXHAUST GAS OF MARINE PROPULSION UNIT

BACKGROUND OF THE INVENTION

This invention relates to an oil remover from the exhaust gas of a marine propulsion unit and more particularly to an improved arrangement for separating and rendering harmless the oil in the exhaust gases of a two-cycle marine engine.

As is well known, many marine engines operate on a two-stroke cycle and are lubricated by introducing lubricating oil into the induction system either directly or through mixture with the fuel of the engine. Although such an arrangement provides obvious simplicity, the exhaust gases of such engines tend to contain a quantity of unburned lubricant. With the present interest and demands in reducing polution, it is desirable to remove the lubricant from the exhaust gases or to render it harmless before it is discharged into the atmosphere or into the body of water in which the watercraft is operating.

It is, therefore, a principal object of this invention to provide an improved arrangement for removing lubricant from the exhaust gas of an engine.

It is a further object of this invention to provide an improved arrangement for rendering harmless the lubricant in the exhaust gases of an engine before the exhaust gases are discharged to the atmosphere.

Various devices have been proposed for the purpose of removing the lubricant from the exhaust gases of an engine. The systems which have been proposed previously, however, are extremely cumbersome and are not fully effective under all running conditions. In addition, the proposed previously proposed systems have required frequent servicing and/or can reduce the efficiency of the exhaust system and causes obstruction to the flow of exhaust gases.

It is, therefore, a still further object of this invention to provide an improved arrangement for rendering harmless the exhaust gases of an internal combustion engine.

It is a further object of this invention to provide an improved arrangement for removing or rendering harmless the lubricant in the exhaust gases of an internal combustion engine which is effective throughout the entire engine speed and load ranges, which does not restrict exhaust gas flow and furthermore which may be serviced when necessary in a convenient manner.

SUMMARY OF THE INVENTION

A first feature of this invention is adapted to be embodied in a two-cycle internal combustion engine that is operated on a fuel lubricant mixture. An exhaust system is provided for discharging the exhaust gases to the atmosphere and these exhaust gases include portions of unburned lubricant. In accordance with the invention, a catalyst is provided for rendering the lubricant in the exhaust gases harmless and this catalyst is located in the engine exhaust system.

Another feature of this invention is adapted to be embodied in an internal combustion engine having an exhaust port and an exhaust system for receiving exhaust gases from the exhaust port and discharging them to the atmosphere. In accordance with this feature of the invention, a catalyst is positioned in the exhaust system in a position wherein the exhaust gases from the exhaust port will impinge upon it but need not flow through it for their discharge through the exhaust system.

A still further feature of this invention is adapted to be embodied in an exhaust system for an internal combustion engine for discharging exhaust gases from an exhaust port of the engine to the atmosphere. In accordance with this feature of the invention, the exhaust system includes a section having a removable wall that supports a catalyst for replacement of the catalyst by removal of the wall.

DETAILED DESCRIPTION OF THE PREFERRED EMBODIMENTS

Figure 1:
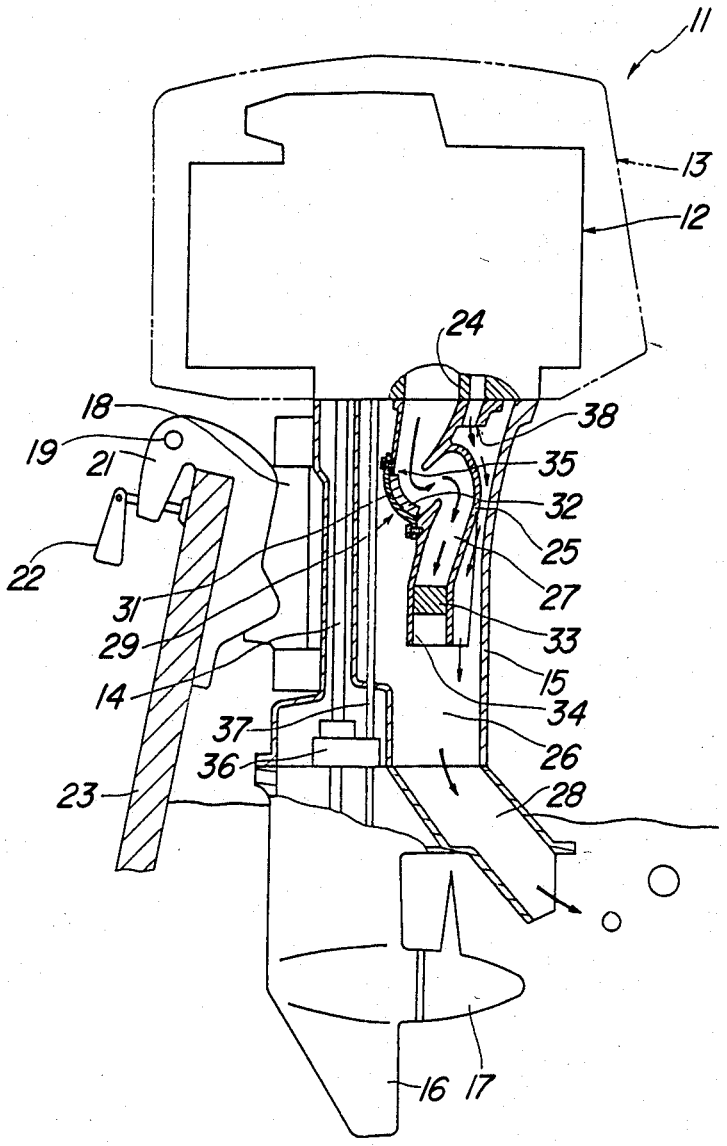
FIG. 1 is a side elevational view of an outboard motor constructed in accordance with a first embodiment of the invention, with portions broken away and other portions shown in section.

Referring first to FIG. 1, an outboard motor constructed in accordance with this embodiment is identified generally by the reference numeral 11. The outboard motor 11 includes a power head consisting of an internal combustion engine 12 and a surrounding protective cowling 13 which is shown in phantom. The engine 12 may be of any known type and operates on the two-stroke crankcase compression principle.

As is conventional with outboard motor practice, the engine 12 is disposed so that its output shaft rotates about a vertically extending axis and is coupled to a drive shaft 14 that is journaled within a drive shaft housing 15. A lower unit 16 is positioned beneath the drive shaft housing 15 and contains a forward, neutral, reverse transmission (not shown) so that the drive shaft 14 may drive a propeller 17 in selected forward and reverse directions, as is well known in this art.

A steering shaft (not shown) is affixed to the drive shaft housing 15 and is rotatably journaled within a swivel bracket 18 for steering movement of the outboard motor 11 about a generally vertically extending axis. The swivel bracket 18 is, in turn, pivotally connected by means of a pivot pin 19 to a clamping bracket 21. The clamping bracket 21 carries a clamping device 22 for affixing the outboard motor 11 to a transom 23 of an associated watercraft.

The engine 12 has an exhaust system that includes an exhaust outlet port 24 which opens through a lower face of the outer casing of the engine 12. The exhaust outlet port 24 communicates with an exhaust pipe 25 that is contained within an expansion chamber 26 formed internally of the drive shaft housing 15. The exhaust gases flow through the exhaust pipe 25 and specifically through an exhaust passage 27 formed therein for expansion in the expansion chamber 26 to achieve silencing. The lower unit 16 is provided with an underwater exhaust gas discharge 28 so that the exhaust gases from the engine 12 may be discharged beneath the level of the body of water in which the outboard motor 11 is operating, as is also well known in this art.

In accordance with the invention, the exhaust pipe 25 is provided with a trap like section, indicated generally by the reference numeral 29 that has a removable wall portion 31. A catalyst 32 is carried internally of the wall portion 31 in an appropriate manner and is disposed so that the exhaust gasses issuing from the exhaust discharge port 24 will impinge upon the catalyst 32 without having to flow through it. The catalyst 32 is an appropriate catalyst for either effecting oxidation of the lubricant contained within the exhaust gases to a harmless non-polluting gas. Alternatively, the catalyst 32 may be a reducing catalyst that changes the lubricant to some other harmless material that may be freely discharged to the atmosphere. Because of the use of a trap 29, water is effectively precluded from contacting the catalyst 32.

A further catalyst material 33 is positioned at the lower end of the exhaust pipe 25 immediately upstream of its discharge opening 34. The catalyst 33 acts upon the other objectional exhaust gas constituents so as to render them harmless.

It should be noted that the removable wall portion 31 closes an opening 35 which is formed in a wall of the exhaust pipe adjacent the trap section 29 so that the catalyst 32 and removable wall portion 31 may be easily removed to replace the spent or otherwise ineffective catalyst during servicing intervals.

The engine 12 is also provided with a water cooling system and this includes a coolant pump 36 that is driven by the drive shaft 14 and which is positioned adjacent the connection between the drive shaft housing 15 and the lower unit 16. The water pump 36 delivers coolant to the engine cooling jacket through a supply conduit 37. The coolant which has circulated through the engine cooling jacket is discharged back into the expansion chamber 26 through a coolant discharge opening 38. The coolant discharge opening 38 is juxtaposed to the trap like section 29 so as to provide some cooling for the exhaust gases and coolant protection against overheating of the catalyst 32.

Figure 2:
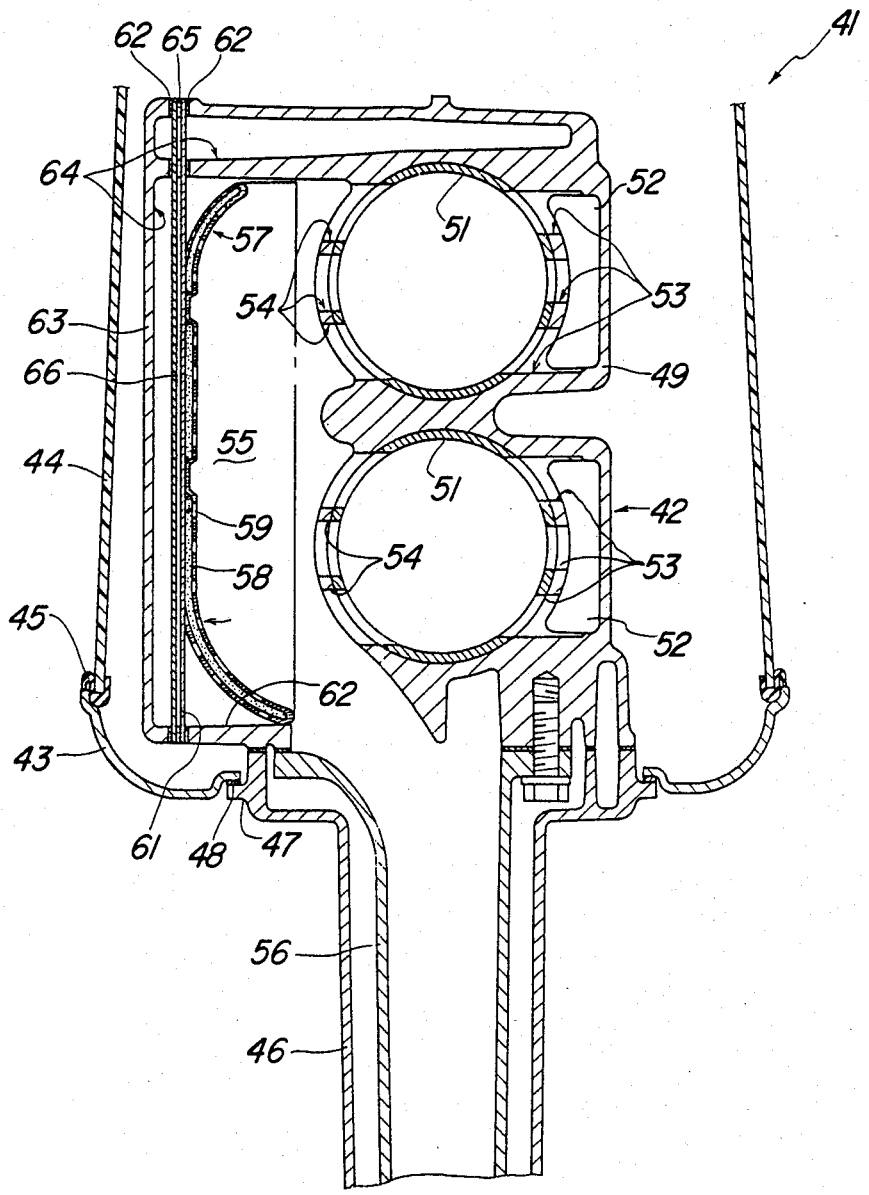
FIG. 2 is an enlarged cross-sectional view of an outboard motor constructed in accordance with another embodiment of the invention.

Another embodiment of the invention is shown in FIG. 2 wherein a portion of an outboard motor constructed in accordance with this embodiment is identified generally by the reference numeral 41. Since the general construction of the outboard motor 41 may be considered to be conventional, only those portions which deal with the invention have been illustrated and will be described in detail.

The outboard motor 41 includes a power head consisting of an internal combustion engine, indicated generally by the reference numeral 42, and a protective cowling consisting of a tray portion 43 and a main cover portion 44 that is affixed to the tray portion 43 in a known manner. A gasket 45 is interposed between the mating faces of the cover portion 44 and tray portion 43 for sealing purposes. A drive shaft housing 46 has an upper flange portion 47 that is engaged by a seal 48 so as to provide a seal between the tray portion 43 and the drive shaft housing 46.

The engine 42 is comprised of a cylinder block 49 having a pair of cylinders 51. Like the previously described embodiment, the engine 42 operates on a two-stroke crankcase compression principle and to this end there is provided a suitable change forming and induction system for delivering a fuel/air lubricant charge to the crankcase chambers. This charge is transferred to the area above the pistons (not shown) in the cylinders 51 at an appropriate time through transfer passages 52 and intake ports 53, as is well known in this art.

There are also provided in the cylinders 51 exhaust ports 54 that open through the sides of the cylinder opposite to the intake ports 53. The exhaust ports 54 discharge the exhaust gases from the engine into a collector section 55 which communicates at its lower end with an exhaust pipe 56 for discharge of the exhaust gases to the atmosphere through an underwater exhaust gas discharge and exhaust system of a known type.

In accordance with the invention, a catalyst, indicated generally by the reference numeral 57, is contained within the collection section 55 in proximity to the exhaust ports 54 so that the exhaust gases issuing from the exhaust ports 54 will impinge upon the catalyst 57. The catalyst 57 includes an outer cover 58 that is formed from a perforated metal plate and which contains a catalyst 59 which may be of either the oxidizing or reducing type, as aforenoted. The perforated plate 58 and contained catalyst 59 are supported by a cover plate 61 that is affixed across an opening 62 formed in the exhaust side of the cylinder block 49.

Gaskets 62 are interposed between the cover plate 61 and the cylinder block 49 and a further coolant jacket cover plate 63 that is affixed to the cylinder block 49 and which assists in holding the cover plate 61 in position. A cooling jacket 64 of the engine through which coolant is circulated in the manner aforedescribed surrounds the cover plate 61. However, the cover plate 61 is provided with an internal insulator 65 so as to insure that the catalyst 59 will not be cooled detrimentally. In addition, the cover plate 61 may be provided with an internal air gap 66 so as to improve the insulating function.

It should be readily that, in this embodiment, the catalyst 57 may be conveniently serviced by removing the cover plates 63 and 61. In addition, the catalyst material 59 is positioned so that the flow of exhaust gases will impinge upon it but the exhaust gases need not flow through it.

Figure 3:
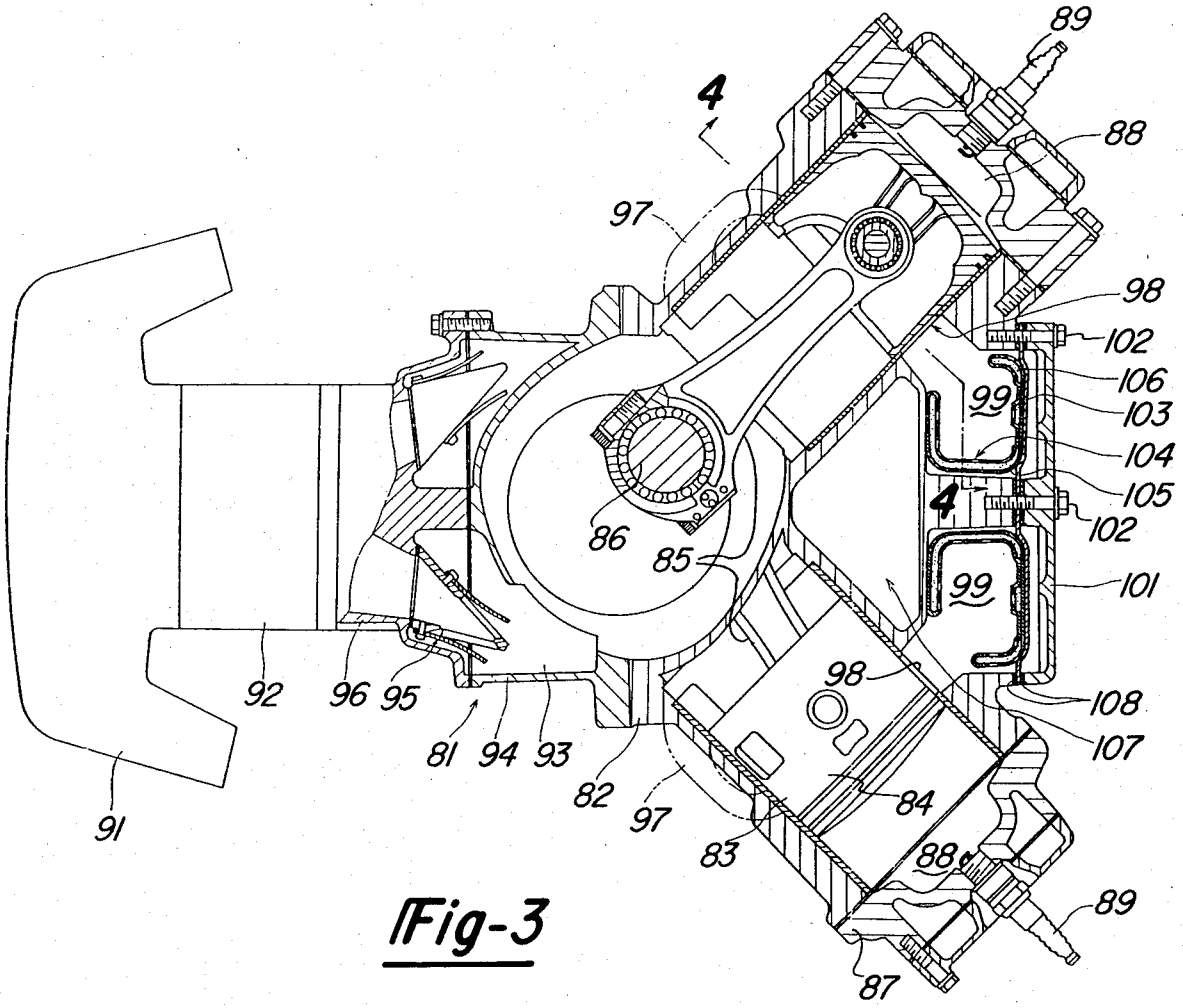
FIG. 3 is a top plan view, with portions shown in section, of an outboard motor constructed in accordance with yet another embodiment of the invention.
Figure 4:
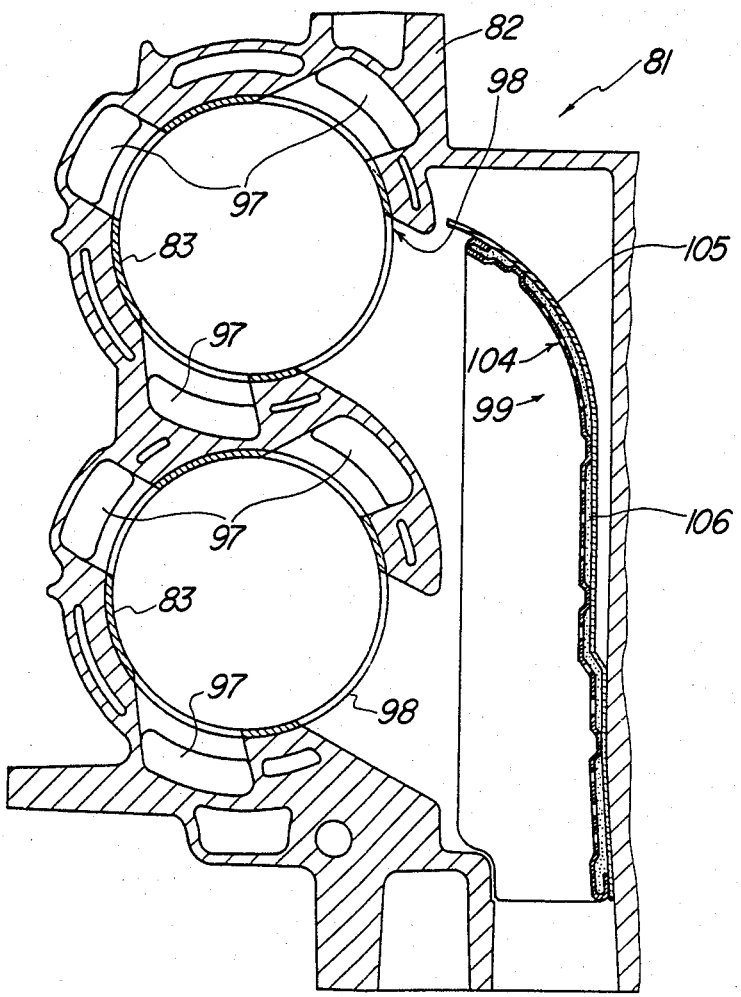
FIG. 4 is an enlarged cross-sectional view taken along the line 4—4 in FIG. 3.
Figure 5:
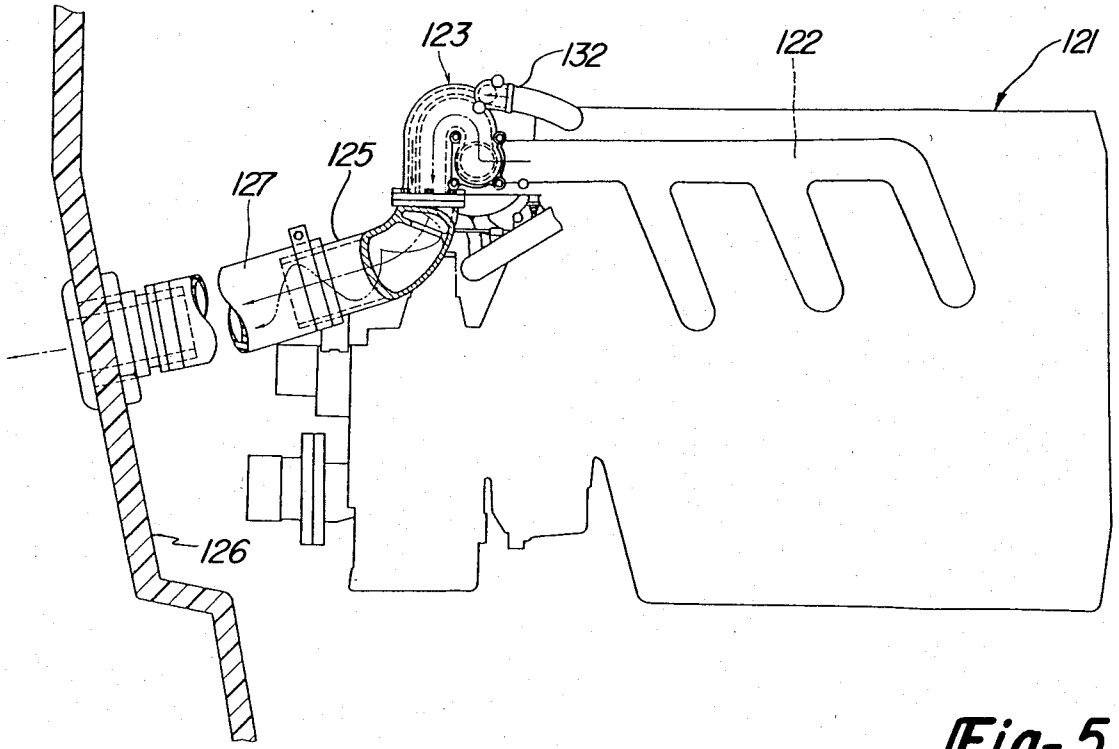
FIG. 5 is a side elevational view, with portions broken away and other portions shown in section, of another embodiment of the invention as applied to an inboard engine.
Figure 6:
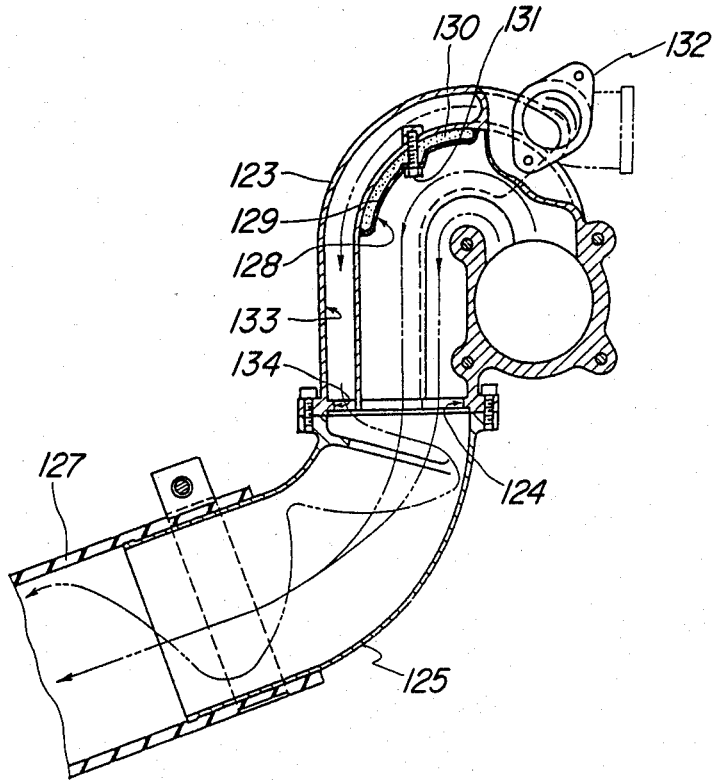
FIG. 6 is an enlarged cross-sectional view showing a portion of the exhaust system of the embodment of FIG. 5.

An outboard motor constructed in accordance with yet another embodiment of the invention is illustrated in FIGS. 3 and 4 and is identified generally by the reference numeral 81. Since the invention is directed primarily toward the engine and particularly its exhaust system, only this portion of the outboard motor 81 has been illustrated and will be described. Reference may be had to FIGS. 1 and 2 for an indication as to how the engine is utilized in combination with an outboard motor. It is believed, however, that this application will be well apparent to those skilled in the art.

In this embodiment, the engine operates on the two-stroke crankcase compression principle and includes a cylinder block 82 having opposed banks of cylinders. In each of the cylinder banks, there is provided a pair of vertically spaced, horizontally extending cylinder bores 83 in which pistons 84 reciprocate. The pistons 84 are, in turn, coupled by connecting rods 85 to a crankshaft 86 that rotates about a vertically extending axis.

The upper ends of the cylinders 83 are closed by respective cylinder heads 87 having combustion chambers 88 in which spark plugs 89 are positioned for firing the charge in a known manner.

The charge is delivered to the engine by means of an induction system that includes an air silencer device 91. The air silencer device 91 draws intake air from the interior of the surrounding protective cowling and delivers it to one or more vertically positioned carburetors 92. The carburetors 92 discharge into respective sealed crankwise chambers 93 associated with each of the cylinders 84. These crankcase chambers 93 are formed by a crankcase 94. Reed type check valves 95 permit the flow into the crankcase chambers 93 through intake passages 96 of an intake manifold. The charge delivered to the chamber 93 contains a mixture of fuel, lubricant and air, as is well known in this art.

The charge compressed within the individual crankcase chambers 93 is transferred to the area above the pistons 84 through scavenge passages 97 and intake ports. The construction of the engine as thus far described may be considered to be conventional and, for that reason, further details of the various engines components are not believed to be necessary to the understanding of the invention.

The cylinders 83 are provided with exhaust ports 98 with the exhaust ports 98 of each cylinder bank discharging into a respective generally vertically extending exhaust cylinder 99. The exhaust collectors 99 communicate at their lower end with an appropriate exhaust system for discharge of the exhaust gases to the atmosphere through an underwater exhaust gas discharge.

The exhaust collector sections 99 open through the wall of the cylinder block 82 in proximity to the area between the banks of cylinders and this opening is closed by means of a cover plate 101. The cover plate 101 is affixed to the cylinder block 82 by means of threaded fasteners 102. A catalyst carrying plate 103 is positioned between the cover plate 101 and the exhaust collector chambers 99. The plate 103 carries a pair of catalyst elements 104 each of which comprises a perforated outer member 105 in which a catalyzer material 106 is positioned. As with the previously described embodiments, the catalyzer material 106 is disposed so that it will be impacted upon by the exhaust gases issuing from the exhaust ports 98 but the exhaust gases need not flow through the catalyzer for their discharge to the atmosphere. Again, the catalyzers 104 may be conveniently replaced by removal of the cover plate 101 and their supporting plate 103.

As with the previously described embodiments, the engine 81 includes a cooling jacket 107 that surrounds the exhaust collector plates 99. Sealing gaskets 108 are interposed between the cylinder block 82, catalyst supporting plate 103 and cover plate 101 but there is no heat insulation in this embodiment. As a result, the catalyzer material may be cooled by the cooling jacket 107.

In the embodiments of the invention as thus far described, the invention has been described in combination with an outboard motor. It is to be understood, however, that the invention may also be practiced with an inboard motor or, in fact, may be practiced with internal combustion engines that are utilized other than in combination with marine propulsion units. However, the invention has particular utility utility in connection with marine applications so as to insure against contamination of the body of water in which the watercraft is operating by lubricant which may be contained in the exhaust gases.

In this embodiment, an internal combustion engine is identified generally by the reference numeral 121. Like the previously described embodiments, the engine 121 operates on the two-stroke principle and has lubricant added to its intake mixture for lubricating the engine. The exhaust gases from the individual cylinders are delivered into an exhaust manifold 122. The exhaust manifold 122 has a trap section 123 or exhaust elbow into which the exhaust gases are discharged. This elbow 123 has a discharge end 124 to which is affixed an exhaust pipe 125 which, in turn, discharges the exhaust gases through a transom 126 of an associated watercraft through a flexible conduit 127.

A catalzer material, indicated generally by the reference numeral 128, is conducted within the elbow 123 and on the center side so that the exhaust gases will impinge upon it without flowing through it. The heavier lubricant will be forced outwardly by centrifugal force due to the curvature so as to insure full contact of the lubricant with the catalyzer 128. The catalyzer 128 includes a surrounding perforated metal container 129 in which a catalyzing material 130 of either the oxidizing or reducing type may be contained. The catalyzer 128 is supported within the exhaust elbow 123 by means of one or more bolts 131 so that the catalyzer 128 may be easily removed for servicing.

The engine 121 is also provided with a cooling system that discharges through a coolant outlet 132 which, in turn, communicates with a coolant passage 133 formed in the elbow 123 in proximity to the catalyzer 128. As with the previously described embodiments, there may be either heat transfer promoted from the catalyzer material 130 to the coolant flowing through the jacket 133 or they may be insulated depending on the operation. Coolant is discharged into the exhaust pipe 125 through a coolant discharge opening 134.

It should be readily apparent from the foregoing description that a number of embodiments of the invention have been illustrated and described each of which is effective to reduce or oxidize the lubricant contained within the exhaust gases before it is discharged to the atmosphere so as to reduce pollution. In each embodiment, the catalyzer may be conveniently removed for servicing and is positioned so that the exhaust gases will impinge upon it but need not flow through it. In this way, there will be no restriction to the flow of exhaust gases. Although a number of embodiments of the invention have been illustrated and described, it should be readily apparent to those skilled in the art that various changes and modifications may be made without departing from the spirit and scope of the invention, as defined by the appended claims.

What is claimed:

1. In a two-cycle internal combustion engine operated on a fuel, lubricant mixture and having an exhaust port and an exhaust system extending from said exhaust port for discharge of exhaust gases to the atmosphere, the improvement comprising a catalyst for rendering harmless lubricant in the exhaust gases and located in said exhaust system, said engine exhaust port facing said catalyst for impingement of the exhaust gases flowing from said exhaust port directly upon said catalyst, said exhaust system having a removable section closing an opening juxtaposed to said catalyst for replacement of said catalyst through said opening upon removal of said removable section.

2. In a two-cycle internal combustion engine as set forth in claim 1 wherein the catalyst is disposed so that the exhaust gases need not flow through it for discharge to the atmosphere.

3. In a two-cycle internal combustion engine as set forth in claim 2 further including a trap positioned in the exhaust system and wherein the catalyzer is disposed within and upstream of the trap.

4. In a two-cycle internal combustion engine as set forth in claim 1 in combination with an outboard motor wherein the internal combustion engine forms a portion of the power head of the motor and the exhaust system includes an underwater exhaust gas discharge.

5. In a two-cycle internal combustion engine as set forth in claim 1 further including a liquid cooling system for the engine and means for delivering coolant from the liquid cooling system into proximity with the catalyst.

6. In a two-cycle internal combustion engine as set forth in claim 5 wherein the catalyst is insulated from the coolant.

7. In a two-cycle internal combustion engine as set forth in claim 5 wherein the catalyst is in heat exchanging relationship with the coolant.

8. In a two-cycle internal combustion engine as set forth in claim 1, wherein the catalyst comprises an outer shell containing a catalyst material, said outer shell having a perforate wall facing said exhaust ports and an imperforate wall disposed on the other side of the catalyst from said perforate wall for precluding flow through the catalyst and for entraining lubricant entering through said perforate wall within the catalyst.

* * * * *